United States Patent [19]

Hartkorn et al.

[11] Patent Number: 5,050,280

[45] Date of Patent: Sep. 24, 1991

[54] EMERIZING APPARATUS WITH MULTIPLE BEATER BLADES

[75] Inventors: Hans Hartkorn; Romuald Vaisnys; Albert Vroomen, all of Moenchengladbach, Fed. Rep. of Germany

[73] Assignee: Gebruder Sucker and Franz Muller GmbH & Co., Fed. Rep. of Germany

[21] Appl. No.: 477,578

[22] Filed: Feb. 9, 1990

[30] Foreign Application Priority Data

Feb. 10, 1989 [DE] Fed. Rep. of Germany ..... 304003

[51] Int. Cl.[5] ..... D06C 11/00

[52] U.S. Cl. ..... 26/28

[58] Field of Search ..... 26/25, 27, 28; 51/38, 51/39, 61, 66, 72 R, 74 R, 76 R, 78, 358

[56] References Cited

U.S. PATENT DOCUMENTS

| | | | |
|---|---|---|---|
| 2,220,627 | 11/1940 | Sperry | 26/28 |
| 2,423,992 | 7/1947 | Nordgren et al. | 51/334 |
| 2,465,225 | 3/1949 | Haren | 51/334 |
| 3,486,276 | 12/1969 | Block | 51/335 |
| 3,553,801 | 1/1971 | Hadley | 26/28 |
| 3,683,559 | 8/1972 | Kalwaites | 51/78 X |
| 3,973,359 | 8/1976 | Spencer et al. | 26/28 X |

FOREIGN PATENT DOCUMENTS

| | | |
|---|---|---|
| 28596 | 5/1907 | Fed. Rep. of Germany . |
| 306958 | 7/1967 | Fed. Rep. of Germany . |
| 1967718 | 9/1967 | Fed. Rep. of Germany . |
| 2532459 | 3/1977 | Fed. Rep. of Germany . |
| 2740402 | 1/1979 | Fed. Rep. of Germany . |

*Primary Examiner*—W. C. Reynolds
*Assistant Examiner*—John J. Calvert
*Attorney, Agent, or Firm*—Shefte, Pinckney & Sawyer

[57] ABSTRACT

An emerizing apparatus is equipped with an emergy roller having multiple beater blades about its circumference, the outer periphery of each beater blade being formed with a pair of axially extending longitudinal beater edges and a concave arcuate recess therebetween, whereby each beater edge is adapted to individually strike a textile web traveling in tensioned engagement with the roller periphery to produce a shorter and more dense napped surface on the textile web than can be achieved by a corresponding conventional emery roller operating at the same rotational speed.

3 Claims, 2 Drawing Sheets

EMERIZING APPARATUS WITH MULTIPLE BEATER BLADES

BACKGROUND OF THE INVENTION

The present invention relates to an emerizing apparatus including an emery-covered roller having multiple beater blades arranged about the periphery of the roller in parallel relation to its axis of rotation.

Emerizing machinery of the above-referenced type is known for working the surface of a textile web to provide a smooth napping of the web face. Typically, the textile web is guided to travel under tension, e.g. under a tractive force, with the web face to be napped in peripheral contact with the emery-covered roller, usually by means of guide rollers or rods contacting the web in advance of and following the emery-covered roller to tension the traveling web along the extent of its travel in contact with the emery-covered roller. The tractive force operating on the web is independent of the emery roller which may be rotated in a direction independent of the direction of travel of the textile web. The beater blades of the roller strike the surface of the web in a wiping-like manner, the abrasive nature of the emery covering of the roller raising the fibers of the web to produce a napped surface.

West German Gebrauchsmuster DE-GM 19 67 718 discloses an apparatus by which the surface fibers of a textile fabric web are loosened and raised to increase the web thickness. For this purpose, the apparatus is provided with one or more rollers each equipped with multiple beater blades for performing a beating and agitating operation on the web surface. In a preferred embodiment, multiple rollers are arranged in an arc and the fabric web is guided to travel in an essentially tangential path in succession over each of the rollers. In this manner, the surface yarns of the fabric web are loosened and raised by the striking action of the beater blades to provide a plush surface effect such as a velour, frotte, or the like.

In the textile industry, a practical distinction is drawn between emerizing machines and grinding machines. It is a characteristic of emerizing machines that the fabric web being treated is held against the surface of the emery roller or rollers of the machine by virtue of longitudinal tensioning of the fabric web itself. The emery roller, as aforementioned, includes beater blades about its periphery in parallel relation to its axis and is wound, preferably in a helical fashion, by an emery-covered belt. In contrast, textile grinding machines utilize a grinding roller the surface of which is coated entirely or in a predetermined pattern with a grinding agent. A representative grinding machine of this type is disclosed in West German Offenlegungschrift DE-OS 25 32 459. In a grinding machine, the textile fabric web to be treated is directed to travel through a nip region between the periphery of a grinding roller and a mating roller arranged in parallel peripheral engagement therewith. The present invention is intended for use primarily only with respect to emery-covered rollers utilized in emerizing machines.

In the operation of emerizing machines, the fabric web to be treated is guided by positioning rods or rollers to travel in contact with a predetermined portion of the circumferential periphery of the emery-covered roller, typically for about one-fourth of its circumference. In this manner, the web surface is contacted indirectly by the beater blades through the emery belt wrapped thereabout, whereby the beater blades exercise a wiping-like effect on the web surface.

It is recognized that the height of the nap raised at the web surface by the action of an emery roller in an emerizing machine is directly related to the period of time per unit length of the web during which the web is maintained in contact with the emery roller and, likewise, the density of the nap produced is directly related to the frequency with which the beater blades strike the fabric web per unit time. Accordingly, for any given emery-covered roller in an emerizing machine, relatively shorter and denser naps would be obtained at relatively higher rotational speeds of the roller, while relatively longer but less dense naps would be obtained at relatively lower rotational speeds of the roller. However, a critical rotational speed is associated with each emery roller according to its axial length at which speed the roller tends to oscillate and is incapable of producing a satisfactory working of a textile web. As will be understood, the roller and its mounting structure must be of a substantially stronger design than is required for normal operation if the critical speed is to be exceeded. In this regard, reference may be made to West German Patentschrift DE-PS 27 40 402.

In light of these considerations, it could be attempted to increase the number of beater blades on the circumference of an emery roller in order to achieve an increased number of web contacts per unit of time without increasing the rotational speed of the roller. However, practical limitations exist on the number of beater blades with which any given emery roller can be equipped. Because the roller rotation produces relatively high centrifugal forces, the beater blades must be securely fastened to the central axial body of the roller. Furthermore, while an increase in the number of beater blades would result in a corresponding increase in the number of contacts made by the beater blades with a textile web per unit of time without a change in the rotational speed of the roller, the duration of each individual contact changes only proportionally to the frequency of the contacts.

SUMMARY OF THE INVENTION

It is accordingly an object of the present invention to provide an improved emery roller for an emerizing machine which, essentially without changing the rotational speed of the roller, enables achievement of a distinct increase in the frequency of beater blade contacts and a superproportional decrease in the duration of each individual beater blade contact in comparison to the state of the art described above.

Basically, the improved emery roller of the present invention is adapted for use in any emerizing apparatus of the initially-described type wherein the emery-covered roller is equipped with a plurality of beater blades arranged in parallel relation to the axis of rotation of the roller with an emery-covered belt wound outwardly about the beater blades. According to the present invention, the aforementioned objective is achieved by providing each beater blade with a pair of axially extending beater edges spaced apart by an intermediate axially extending recess for successive individual striking of the textile web by the beater edges.

As a result of this construction of each beater blade with two separately-acting longitudinal beater edges, the frequency with which the beater edges strike a textile web is doubled without changing the rotational speed of the emery roller while at the same time the duration of each individual blade contact may be reduced in even greater proportion by configuring the edges to be relatively narrow as measured circumferentially of the roller. In contrast, only the leading edge of beater blades of conventional construction serve to actively make striking contact with the textile web, the trailing edge of the blade being essentially inactive as a beating edge.

A further improvement in the emery roller construction of the present invention may be achieved by configuring the two beater edges of each beater blade to be rounded at a radius of curvature on the order of the height of the nap to be produced on the web surface. As a result, the duration of contact by each beater edge with the textile web may be considerably shorter than a corresponding conventional beater blade having a periphery which follows the emery roller circumference, even when the rotational speed of the roller is reduced by one-half.

Essentially, the radial depth of the recess between the two beater edges of each beater blade can be of any desired dimension. However, the recess must be of a minimum depth sufficient to enable the trailing beater edge to serve a web striking function. As a practical maximum, the recess can extend to approximately the same depth as fasteners which are situated between successive beater blades to secure them to the central body of the emery roller.

According to another feature of the present invention, the recess of each beater blade of the present emerizing roller is configured to be arcuate in cross-section taken radially with respect to the emerizing roller (i.e. in each plane through each beater blade recess which plane is perpendicular to the axis of the roller and intersects each radius thereof) and to be substantially flat (i.e. linear) in cross-section taken axially through the emerizing roller (i.e. in each plane through each beater blade recess which plane intersects the axis of the roller), whereby the recess is essentially concave. With each beater blade having a recess of this configuration and each beater edge being of the aforementioned relatively narrow, rounded configuration, the emerizing roller of the present invention produces advantageous processing results in terms of achieving a desired height and density in the surface nap of the textile web being treated. The arcuate recess is preferably formed in a circular arc of a uniform radius of curvature which can be relatively large, preferably in the range of approximately one-half to one-fourth the overall circumferential dimension of each beater blade. Beater blades according to this construction can be relatively inexpensively manufactured to be sufficiently resistant to breakage. Regardless of the actual configuration of each beater blade, the primary factor is that the leading portion of the trailing beater edge of each beater blade (as viewed in the direction of rotation of the emery roller) be suitably configured to contact a textile web traveling over the emery roller in substantially the same manner as a conventional beater blade.

DESCRIPTION OF THE PREFERRED EMBODIMENT

Figure 1:
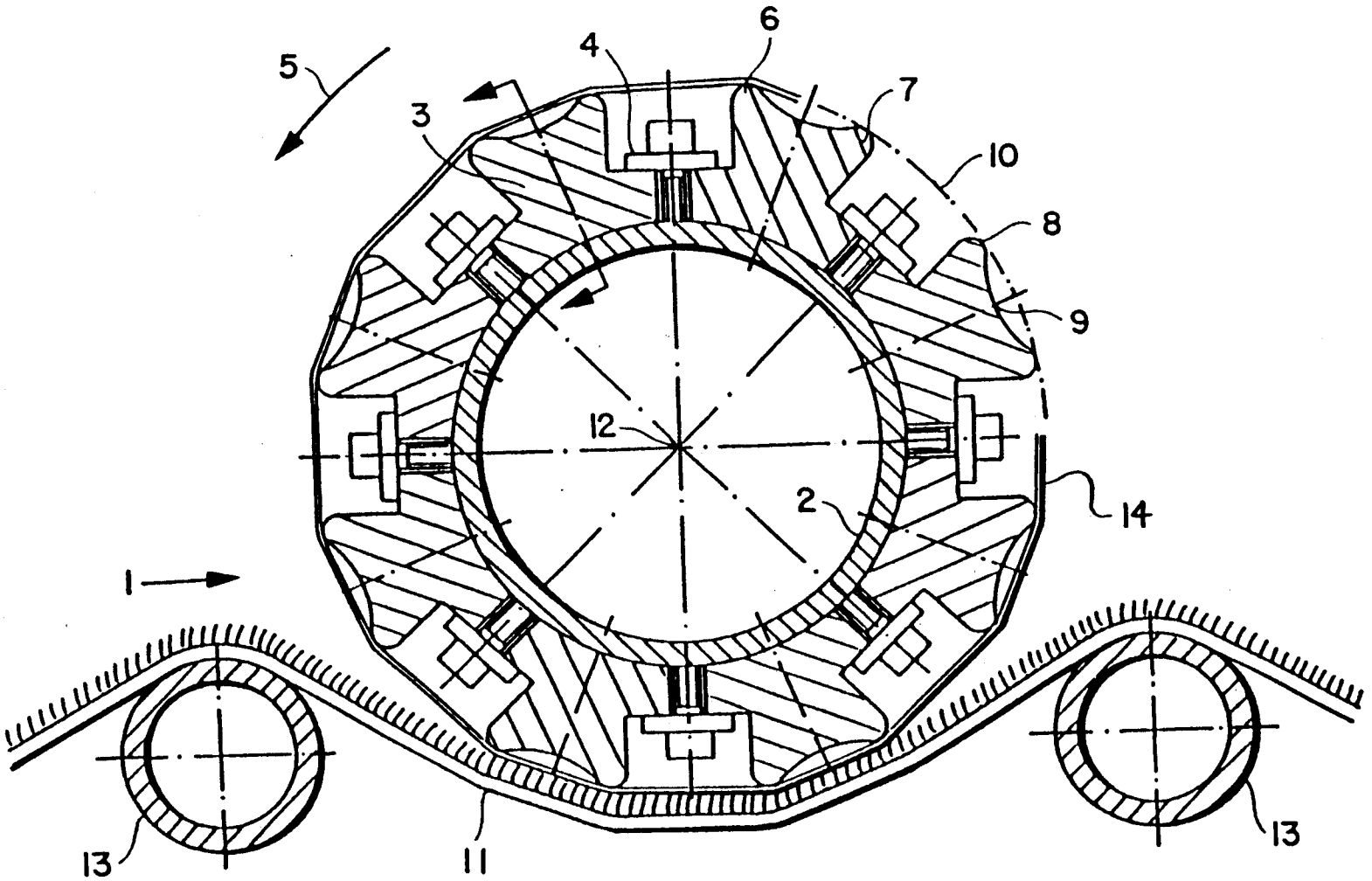
FIG. 1 is a schematic radial cross-sectional view of an emery roller in an emerizing apparatus according to the present invention.
Figure 2:
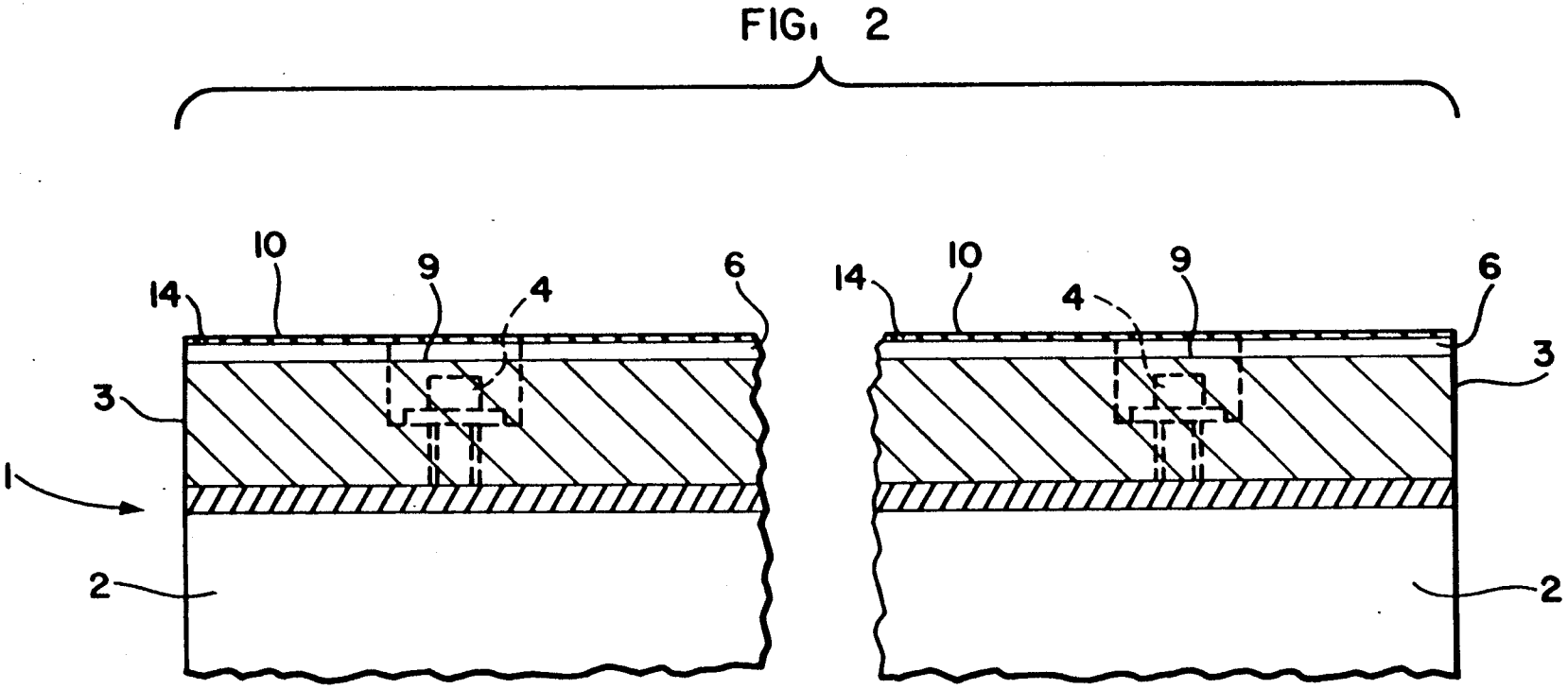
FIG. 2 is a schematic axial cross-sectional view taken through one of the beater blades of the emery roller of FIG. 1 along line 2—2 thereof.

Referring now to the accompanying drawing, an emery roller of an emerizing apparatus according to the preferred embodiment of the present invention is illustrated in radial cross-section and broadly designated in its entirety at 1. The emery roller 1 has a central cylindrical main body 2 to which plurality of beater blades 3 are affixed by intervening threaded bolts 4. The beater blades 3 cover substantially the entire circumference of the central body 2, each beater blade 3 being elongated to extend substantially the length of the central body 2 in parallel relation to the rotational axis 12 thereof. The beater blades 3 are preferably fabricated of wood while the main body 2 is preferably of a tubular configuration fabricated of a suitable metal. The number of threaded bolts 4 utilized to secure the beater blades 3 to the main body 2 is a function of the length and quality of the beater blades 3. An emery-covered belt 14 is wound tightly, preferably in a helical manner, outwardly about the beater blades 3 over the full circumference and length thereof, whereby the emery belt 14 conforms to the peripheral configuration of the beater blades 3 to provide an emery covering over the circumference of the emery roller in the form of multiple polygonal belt sections. As will be understood, the number of corners or edges produced by this conformed configuration of the emery belt is determined by and equal to the number of beating edges formed by the beater blades 3 as hereinafter more fully described.

As viewed in the direction of rotation of the emery roller 1, indicated by the directional arrow 5, each beater blade 3 is configured to have a leading edge 6 and a trailing edge 7, each extending lengthwise along the beater blade 3 in substantially parallel relation to the axis of rotation 12 of the emery roller 1. Of course, as will be understood, if the direction of rotation of the roller 1 were opposite, the edge 7 would act as the leading edge and the edge 6 would act as the trailing edge. In contrast to conventional emery rollers wherein the periphery of each beater blade is configured as a substantially convex arcuate segment conforming to the overall circumference of the emery roller, each emery roller 1 of the present invention is formed with a concave recess 9 between its leading and trailing longitudinal edges 6,7. As a result of the recesses 9 formed in the beater blades 3, the leading and trailing longitudinal edges 6,7 of each beater blade 3 act as separate beating edges on a web of textile material 11 traveling under a downstream tractive force in contact with the outer periphery 10 of the emery roller 1. As aforementioned, the recesses 9 can be formed to substantially any desired radial depth in the beater blades 3, even to substantially the level of the securing bolts 4 if the material from which the beater blades 3 are fabricated is sufficiently stable and strong.

As illustrated in the drawing, the circumferential extent of the emery roller 1 over which the traveling textile web 11 is maintained in contact with the roller periphery 10 can be selectively determined by the provision of guide rods or rollers 13, or other suitable elements, which tension the extent of the textile web 11 therebetween to hold it in contact with the rotating periphery 10 of the emery roller !. In the illustrated embodiment, the textile web 11 is maintained in contact with the emery roller 1 over approximately one-fourth of its overall circumference, i.e., over an angular extent of approximately 90 degrees.

It has been found in practice to be advantageous to the outcome of the emerizing operation of the emery roller 1 to configure the leading and trailing longitudinal edges 6,7 of each beater blade 3 as essentially separate and distinct beating edges each of a substantially rounded configuration. For example, the longitudinal beating edges 6,7 can be formed at a radius of curvature on the order of the height to which the nap of the textile web is to be raised, e.g., on the order of approximately 5 millimeters. It has also proven to be advantageous in practice to achieve an economical manufacture and assembly of the emery roller 1 to configure the recess 9 of each beater blade 3 in the form of a circular arc of a uniform radius of curvature, as viewed in cross-section taken radially with respect to the emery roller 1, and in turn of a substantially flat longitudinal extent, as viewed in cross-section taken axially with respect to the emery roller 1. In the illustrated embodiment, the recess 9 of each beater blade 3 is formed of an arcuate configuration having a radius of curvature on the order of approximately two-thirds of the overall circumferential dimension of each beater blade 3 at the outer periphery 10 of the emery roller 1.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An emerizing apparatus comprising an emery-covered roller for peripheral surface contact with a textile web traveling continuously under a tractive force independent of said roller to produce a raised surface nap on the textile web, and means for rotating said roller in a direction independent of the direction of travel of the textile web, said roller having a plurality of beater blades arranged in parallel relation to the axis of rotation of said roller and an emery-covered belt wound outwardly about said beater blades, each said beater blade having a pair of axially extending beater edges spaced apart by an intermediate axially extending recess for successive individual striking of the textile web by said beater edges.

2. An emerizing apparatus according to claim and characterized further in that each said beater edge is rounded at a radius of curvature on the order of the height of the nap to be produced on the web surface.

3. An emerizing apparatus according to claim 1 and characterized further in that each said recess is arcuate in radial cross-section and substantially flat in axial cross-section.

* * * * *